United States Patent [19]

Kumai et al.

[11] 4,073,643

[45] Feb. 14, 1978

[54] CONTINUOUSLY CAST STEEL SLABS FOR STEEL SHEETS HAVING EXCELLENT WORKABILITIES AND METHOD FOR PRODUCTION THEREOF

[75] Inventors: Ko Kumai; Koichi Asano; Hideharu Bando, all of Himeji, Japan

[73] Assignee: Nippon Steel Corporation, Tokyo, Japan

[21] Appl. No.: 703,218

[22] Filed: July 7, 1976

Related U.S. Application Data

[63] Continuation-in-part of Ser. No. 627,869, Oct. 31, 1975, abandoned, which is a continuation of Ser. No. 472,358, May 22, 1974, abandoned.

[51] Int. Cl.[2] ..... C21C 7/10

[52] U.S. Cl. ..... 75/49; 75/60; 75/123 R

[58] Field of Search ..... 75/49, 60, 123

[56] References Cited

U.S. PATENT DOCUMENTS

| | | | |
|---|---|---|---|
| 3,575,695 | 4/1971 | Miyashita | 75/57 |
| 3,702,243 | 11/1972 | Miltenberger | 75/49 |
| 3,810,753 | 5/1974 | Miltenberger | 75/49 |
| 3,822,735 | 7/1974 | Miltenberger | 75/57 |

*Primary Examiner*—Peter D. Rosenberg

*Attorney, Agent, or Firm*—Toren, McGeady and Stanger

[57] ABSTRACT

A continuously cast slab for steel sheets having excellent workabilities which comprises not more than 0.02% of carbon, not more than 0.6% of manganese, not more than 0.005% of sol. aluminum, not more than 0.005% of titanium with a reduced silicon content of less than 0.02% and a reduced content of silica inclusions and the balance being iron and unavoidable impurities and a method for producing the steel slab.

2 Claims, 8 Drawing Figures

HOT COIL (x400)

COLD ROLLING REDUCTION 65% (x800)

HOT COIL (x400)

COLD ROLLING REDUCTION 65% (x800)

BLOWING-OFF TEMPERATURE 1600 ~ 1650°C

CONTINUOUSLY CAST STEEL SLABS FOR STEEL SHEETS HAVING EXCELLENT WORKABILITIES AND METHOD FOR PRODUCTION THEREOF

CROSS REFERENCE TO RELATED APPLICATIONS

This is a Continuation-in-Part of application Ser. No. 627,869, filed on Oct. 31, 1975, and now abandoned, which, in turn, is a Continuation of application Ser. No. 427,358, filed May 22, 1974, now abandoned.

BACKGROUND OF THE INVENTION

1. Field of the Invention

The present invention relates to continuously cast steel slabs for producing hot rolled steel sheets and strips and cold rolled steel sheets and strips including those for plating, which possess excellent workabilities and a production method therefore. More particularly, the object of the present invention is to provide continuously cast steel slabs for producing hot rolled steel sheets and strips and cold rolled steel sheets and strips, including those for plating, having excellent workabilities, such as, deep-drawability, stretchability, bore expansion properties, etc. attained by remarkably lowering the contents of silicon and silica inclusions in the steel.

2. Description of the Prior Art

In the continuous casting of steel, when excessive oxygen is contained in the steel, blow holes are caused which have adverse effects on the continuous casting operation or its products, and thus it is necessary to deoxidize the steel prior to continuous casting.

To remove the oxygen in the molten steel, vacuum degassing and deoxidation by metal deoxidizing agents, such as, Al, Si, etc., are generally used. Also, as for the continuous casting method, various methods have been proposed and disclosed, for example, by U.S. Pat. No. 3,412,781, Japanese Patent Publication Sho 47-47209, Japanese Laid-open Patent specifications Sho 47-31828 and Sho 47-31827. According to the methods disclosed by these prior publications, deoxidation agents are selected and used corresponding to the particular purpose of the steel and complex deoxidation by Al and Si are carried out.

It has been found, however from extensive and various studies conducted by the present inventors, that it is possible to remarkably improve the deep-drawability and stretchability and bore-expansion properties of cold rolled steeel sheets and strips and the bore-expansion properties of hot rolled steel sheets and strips.

Among the various properties and characteristics required for cold rolled steel sheets and strips, excellent deep-drawability and stretchability, in particular, are very important for press-forming, and the bore-expansion property is also an important characteristic for easy bore-expansion working of the opening portions of cans made, for example, from tinned steel sheets. Further, the bore-expansion property is required also for hot rolled steel sheets and strips, and it is very important in the fabricating of motor cases from hot rolled steel sheets, for example, that the joint portions between the cases and other members can be easily bore-expanded.

SUMMARY OF THE INVENTION

According to the present invention, it is possible to provide continuously cast slabs which enable the production of steel sheets and strips having an excellent bore-expansion property in addition to other material characteristics similar to or better than those of rimmed steels. This could not be obtained by conventional continuously cast materials.

The features of the present invention lie in:

1. a continuously cast steel slab for production of steel sheets and strips having excellent workabilities, which comprises not more than 0.02% of C, not more than 0.6% of Mn, not more than 0.005% of sol.Al, not more than 0.005% of Ti, and less than 0.02% of Si, with the balance being iron and unavoidable impurities and a silica inclusion clearness of $d_{60} \times 400 \leqq 0.01\%$; and
2. a method for producing a continuously cast steel slab for steel sheets and strips having excellent workabilities, which comprises blowing molten steel to a total oxygen content between 600 ppm and 1600 ppm with a carbon content of not more than 0.10% and a reduced silicon content of less than 0.02%, tapping the molten steel into a ladle, subjecting the molten steel to vacuum degassing to decarburize and deoxidize the molten steel together with deoxidation adjustment by Al or Al and Ti to obtain a molten steel containing not more than 0.02% of C, less than 0.02% of Si, not more than 0.6% of Mn, not more than 0.005% of sol.Al, not more than 0.005% of Ti, not more than 150 ppm of free oxygen and a reduced content of silica inclusions, and continuously casting the molten steel and breaking down the continuously cast steel with a cold reduction of less than about 60% to obtain a silica inclusion clearness of $d_{60} \times 400 \leqq 0.01\%$.

DESCRIPTION OF THE PREFERRED EMBODIMENT

The present inventors have conducted various extensive studies on factors affecting the deep-drawability, stretchability, and bore-expansion properties of steel materials manufactured from continuously cast slabs, and it has been found that the contents of silicon and silica inclusions have predominant effects on these properties.

As an index for deep-drawability of a steel sheet, the plasticity strain ratio, namely, the *r* value by Rankford (herein called *r* value) is used, and it is commonly accepted that a higher *r* value means better deep-drawability. Also, as for the mechanical test value indicating the deep-drawability, the conical cup value (c.c.v.) is used, and a smaller c.c.v. value indicates a better deep-drawability. What controls the *r* value and c.c.v. value is the texture of the steel, and it is well known that a structure having more planes (111) almost parallel to the sheet surface and fewer planes (100) shows a better $r$ value and a lower c.c.v. value. Stretchability is judged from the Erichsen value (Er) and a higher Er value indicates a better stretchability. Other than the above values, the elongation value for estimation of ductility of the steel which has been given importance in the art is also important.

Figure 1:
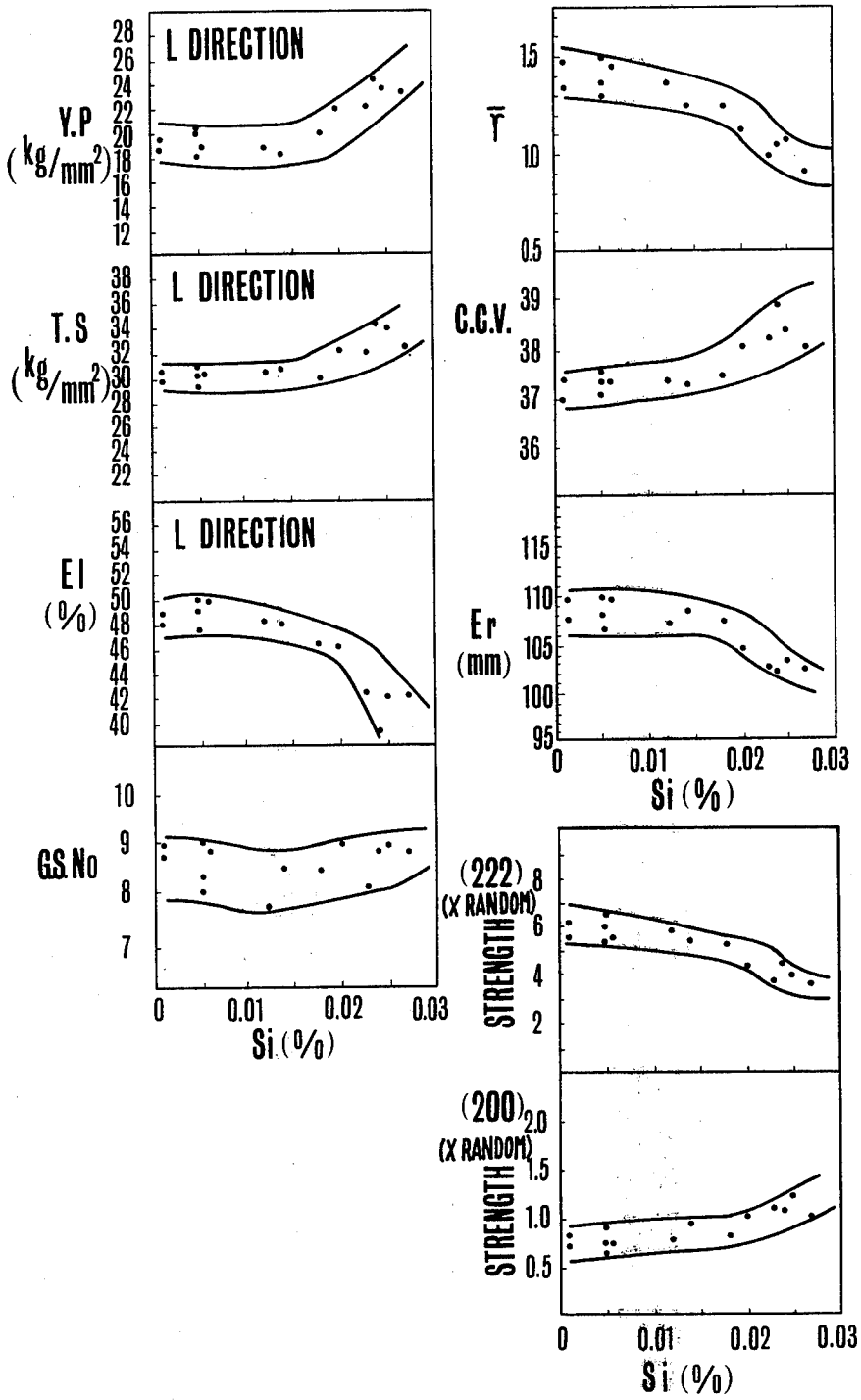
FIG. 1 is a graph showing the effects of Si on various properties of cold rolled materials from a continuously cast slab.

FIG. 1 shows the effects of the silicon contents on various properties of steel sheets produced from a continuously cast slab having a chemical composition shown in Table 1 and a continuously cast slab having a similar chemical composition. These steel sheets were obtained by vacuum degassing the molten steel, continuously casting the molten steel, hot rolling the slab at a finishing temperature between 850° C and 860° C into a hot coil of 2.5 mm thickness, acid pickling the hot coil, cold rolling the coil into 0.8 mm thickness, and annealing the strip at 670° C for 3 hours. Regarding the $r$ value, an average value of the $r$ value in the rolling direction, the $r$ value in the 45° direction and the $r$ value in the sheet width direction is shown as $\bar{r} = (r_L + 2r_{45}o + r_c)/4$. It is clear from FIG. 1 that various properties of a cold rolled steel sheet are largely influenced by the silicon content.

Although the grain size is not much influenced by the silicon content, the behavior of the yield point (Y.P.) and tensile strength (T.S.) change largely at a silicon content of 0.02%. Namely, with a silicon content above 0.02%, the yield point rises as the silicon content increases, while with a silicon content less than 0.02%, the yield point and the tensile strenght do not change and maintain an almost constant value of 19 kg/mm$^2$ and 30 kg/mm$^2$, respectively. On the other hand, the elongation becomes very high with a silicon content of less than 0.02% and becomes more than 45%, but it decreases very sharply with a silicon content of more than 0.02%.

The $\bar{r}$ and c.c.v. values which are very important for quantifying deep-drawability, show a very excellent value, namely, more than 1.25 and less than 37.5, respectively, with a silicon content of less than 0.02%, while the yield point and the tensile strength maintain an almost constant value when the silicon content is less than 0.02%. Even in this range, the $\bar{r}$ value increases steadily as the silicon content lowers. When the silicon content is about 0.001%, the $\bar{r}$ value reaches 1.5 which is a value satisfactory for super deep-drawability, Further, the effects of the silicon content on the texture are remarkable and directly dominate the $\bar{r}$ value. Also, the (111) texture parallel to the sheet plane, which is favorable for deep-drawing becomes more than 5.0 when the silicon content is less than 0.02%, and this texture increases even when the silicon content decreases within the range below 0.02%. While the (100) texture parallel to the sheet surface, which is undesirable for deep-drawability is not more than 1.0 and, in contrast to the (111) texture, the (100) texture decreases when the silicon content is lowered to within the range of less than 0.02%.

The steel materials of the present invention in which the silicon content is lowered to less than 0.02% show better properties than those of the comparative steel, rimmed B slab as set forth in Table 1. The Erichsen value (Er) which is important for stretching, is inferior to that of the rimmed B slab, but this value can be considerably improved and shows a value not lower than 1.06 when the silicon content is lowered to less than 0.02%.

As described above, the effects of Si within the range of less than 0.02% on the properties of various steel materials are different. One important effect of Si, newly discovered by the present inventors, is that the hardness of the steel does not change substantially in the case of a steel having a silicon content less than 0.02%, as is seen from the yield point and tensile strength, but the texture and properties, such as, the $\bar{r}$ value and c.c.v. value are greatly influenced even by a very small amount of silicon in the range less than 0.02%. Moreover, when the silicon content is less than 0.02%, the silica inclusions can be decreased to maintain a silica inclusion clearness of $d_{60} \times 400 \leqq 0.01\%$. Therefore, it is assumed that most of the silicon exists in the form of a solid solution with a silicon content of less than 0.02% and the silicon in this form produces the desireable influence on the texture, etc.

In the case of sample D, Al and Ti were used in combination as a deoxidation adjustment agent, but this sample gave no substantial difference in its material quality from the samples A, B, C and E which were deoxidized and adjusted by Al alone.

It should be noted in this regard that the steel in accordance with the present invention is not an aluminum killed steel. Thus, the workability of such steels, i. e., aluminum killed steels, depends on the aluminum nitride content. Consequently, even when such steels possess a relatively low silicon content, the workability still depends primarily on the amount and distribution of the aluminum nitride.

In the present invention, the upper limit of the soluble aluminum content is set at 0.005% since when the soluble aluminum content exceeds this value, the steel structure in the low solubility aluminum zone will be a mixed-grain structure which causes problems during the working of the steel product. When the soluble aluminum content increases and falls within the zone normally obtained with an aluminum killed steel, the deoxidation product, namely, $Al_2O_3$, causes clogging of the nozzle in the continuous casting process or defects due to the inclusions of this material.

Additionally, it is further noted that while the upper limit of the soluble aluminum in the steel of the present composition is set at 0.005%, this does not mean that soluble aluminum must be added to attain this value. Thus, for example, if satisfactory deoxidation can be obtained by vacuum treatment alone, it is unnecessary to add aluminum or titanium, as discussed hereinafter. However, aluminum or titanium are used merely because deoxidation can be more easily performed if the vacuum treatment is combined with deoxidation by aluminum or titanium in actual practice. This is completely different from the technical processing utilized in a steel which is aluminum killed. In this latter type process, a large amount of aluminum is added in order to maintain the required amount of soluble aluminum.

Further, the present inventors have studied and analyzed various factors affecting the bore-expansion property of a steel sheet made from a continuously cast steel slab and have found that the form of the inclusions contained in the steel sheet exerts remarkable influences. Thus, the inclusion of group C (alumina inclusions) has almost no influence on the bore-expansion property, but the inclusions of group A (silica inclusions) have an adverse influence.

Figure 2:
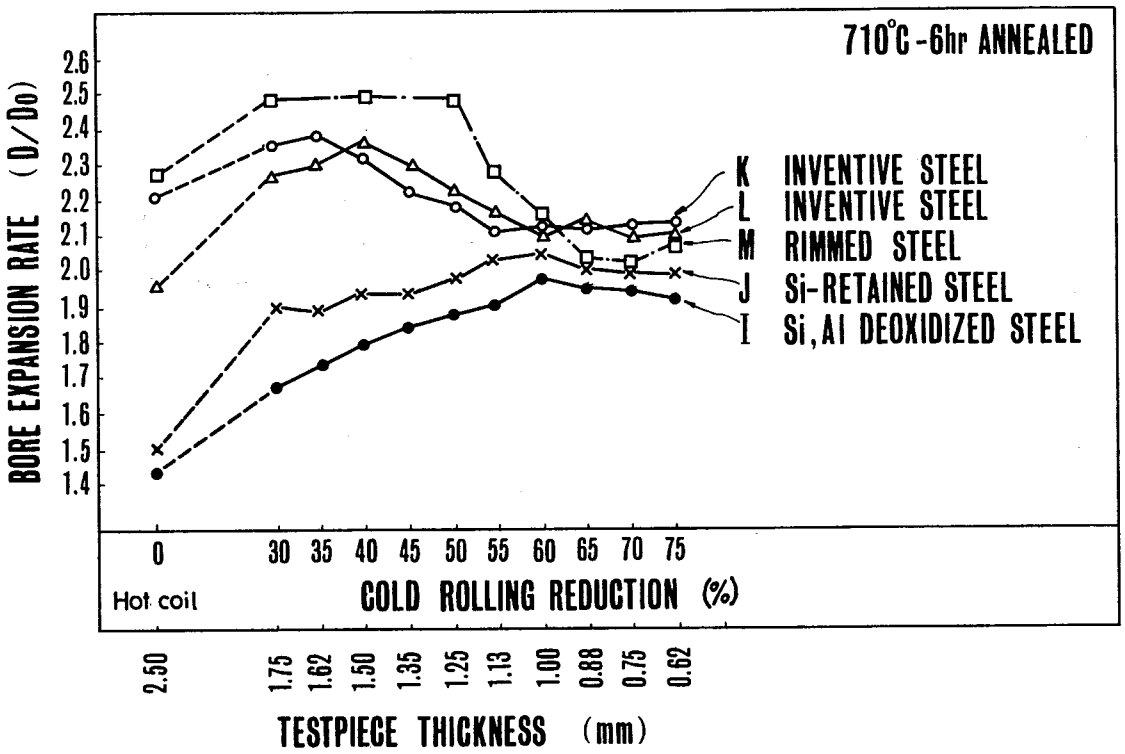
FIG. 2 is a graph showing the bore-expansion rates of a hot coil and the relation between cold rolling reduction and bore-expansion rates.

FIG. 2 shows the bore-expansion rates ($D/D_o$; $D_o$= initial bore diameter, D = limit diameter after bore-expansion) of steel sheets prepared by hot rolling various steel compositions shown in Table 2 at a finishing temperature between 850° and 865° C into hot coils of 2.5 mm thickness, cold rolling the coils at various reductions, and annealing the strips at 710° C for 6 hours.

As clearly understood from Table 2 and FIG. 2, the bore-expansion property changes remarkably depending on the silicon content in the steel. In the case of steels I and J which contain a large amount of silicon, in order to maintain a good bore-expansion rate, cold rolling may be done at a high reduction rate in a very small range. However, even by this method, the bore-expansion rate as obtained by the rimmed steel B, which is generally considered to have excellent workability, cannot be attained.

The poor bore-expansion property of the samples I and J, particularly, when they are rolled at a low reduction rate, is attributed to the large amount of silica inclusions and their unsatisfactory breaking by cold rolling.

In contrast, in the case of the present inventive steels K and L, which have a lowered silicon content, an almost equal bore-expansion rate as in the rimmed steel B can be obtained, irrespective of the cold rolling reduction, and at a high reduction rate of not less than 65%, a bore-expansion rate higher than that of the rimmed steel B can be obtained.

Meanwhile, the general decreasing of the bore-expansion rate with a corresponding increase of the reduction rate as seen in the steels K, L, and M, are due to the sheet thickness decrease. Also, FIG. 2 shows the bore-expansion rate of the 2.5mm thick hot coiled strip. The hot coiled strips K and L from the present inventive steel slabs show lower bore-expansion rates than that of the rimmed steel B, but far higher bore-expansion rates than those of the hot coiled strips I and J containing more than 0.02% of silicon.

Figure 3A:
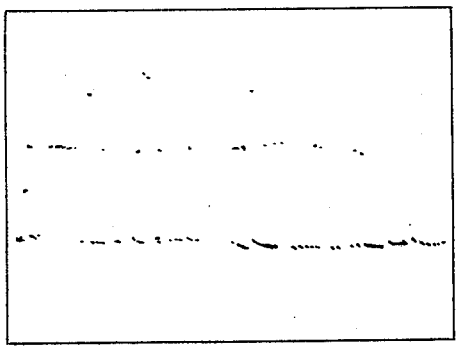
FIGS. 3*a* and 3*b* are photomicrographs showing silica inclusions in Sample J.
Figure 3B:
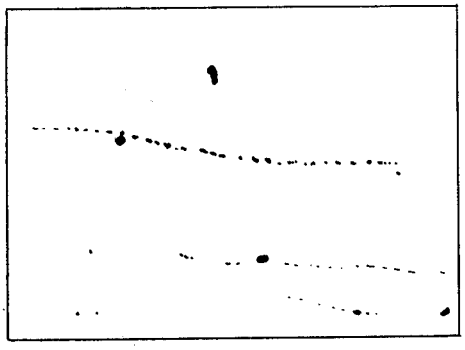
Figure 4A:
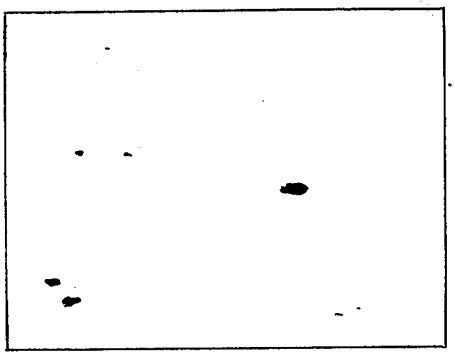
FIGS. 4*a* and 4*b* are photomicrographs showing (Fe Mn)O inclusions in Sample K from the slab prepared according to the present invention.
Figure 4B:
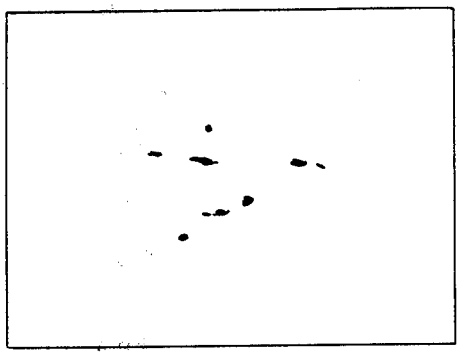

Next, the photograph of FIG. 3 shows the forms of inclusions in the sample J, shown in Table 2, and the photograph of FIG. 4 shows the forms of inclusions in the sample K made from the slab of the present invention.

As is clearly understood from the comparison of FIG. 3 and FIG. 4, the inclusions of the steel containing less silicon content shown in FIG. 4 are (Fe Mn)O inclusions and thus belong to the group C inclusions. On the other hand, the inclusions in FIG. 3 are silica inclusions in an elongated form, belonging to the group A inclusions which remarkably deteriorate the bore-expansion property.

In order to reduce the adverse effects of these silica inclusions in the method of the present invention, these inclusions are broken by cold rolling at a high reduction rate of not less than 60%. However, by this means, i. e., without the appropriate steel composition, high bore-expansion rates as attained by the samples K and L made from the inventive slabs which contain substantially no silica inclusions, cannot be attained.

The amount of silica inclusions which influences the bore-expansion property is shown as the silica inclusion clearness ($d_{60} \times 400$) in Table 2. This value is determined by inserting a glass plate having 20 lattice lines in each of the longitudinal and horizontal directions to the ocular of a microscope. Microscopic examinations of the test samples are repeated at random to calculate the number of lattice points occupied by the inclusions. The number of the field observed is 60, and the magnification of the microscope is 400 x. The amount of inclusions determined by this procedure is expressed as $d_{60\times400}$ (%) to express the silica inclusion clearness.

A higher value of inclusion clearness indicates a large content of inclusions. As is clear from the table, the samples K and L made from the inventive slabs show a low inclusion clearness of $d \leqq 0.01$, while the samples I and J, which contain more than 0.02% of silicon, possess a $d = 0.05$ and a $d = 0.12$, respectively, indicating a very large content of silica inclusions.

It should be particularly noted that, in the case of the samples K and L which contain less than 0.02% of silicon, the contents of the silica inclusions in these samples are equal ($d = 0.01$) even in view of the difference between the silicon contents (0.005% and 0.016%). This means that when the silicon content exceeds 0.02%, the silica inclusions increase sharply. Therefore, it is very important to maintain the silicon content at less than 0.02%.

Further, Table 3 shows the results of bore-expansion tests conducted on tinned steel sheets (T-2) prepared by hot rolling steels having essentially the same compositions as shown in Table 2 (finishing temperature between 840° C and 855° C) to obtain 2.3 mm thick hot coiled strips, acid pickling the hot coils, cold rolling the strips into 0.32 mm thickness, and annealing the strips at 660° C for 10 hours. The results show that same order of bore-expansion rates under high cold reductions as shown in Table 2. Sample P from the inventive slab gives a slightly better value than sample Q from the rimmed steel B. Naturally, it shows a considerably higher bore-expansion rate than samples N and O containing more than 0.02% silicon.

As described hereinabove, when the silicon content is less than 0.02%, the silica inclusions suddenly disappear almost completely at a silicon content of 0.02% and the content of the silica inclusions does not depend on the silicon content. Also, when the silicon content is less than 0.02%, the workability, and particularly, the deep-drawability of the steel sheet are improved. This is due to the fact that the (111) texture develops as the silicon content becomes lower than 0.02% and the $r$ value increases. Naturally, the elongation and stretchability are improved when the silicon content gets less than 0.02%.

Figure 6:
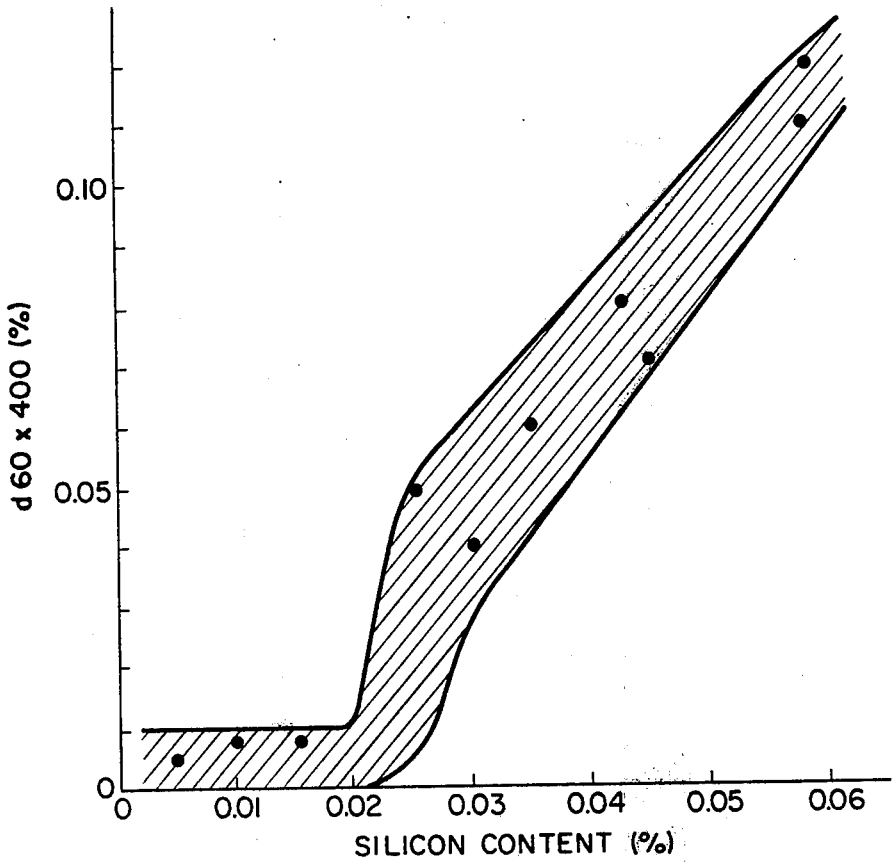
FIG. 6 is a graph showing the relationship of the silicon inclusion clearness to the silicon content.

Further, the bore-expansion property of hot coiled strips, cold rolled steel sheets and strips, tinned steel sheets, etc., depends largely on the content of silica inclusions, and when the silicon content becomes more than 0.02%, the silica inclusions increase sharply and deteriorate the bore-expansion properties. The relationship between the silicon content and the silica inclusions (group A) clearness, $d_{60\times400}$ (%), is as shown in FIG. 6. When the silicon content is less than 0.02%, $d_{60\times400}$ becomes not more than 0.01%, and when the silicon content exceeds 0.02%, the amount of silica inclusions (group A) increases suddenly. For the reasons as above-described, the silicon content in the steel sheet or strip made from the slab is limited to less than 0.02% in the present invention.

In contrast, according to U.S. Pat. No. 3,412,781, Japanese Patent Publication Sho 47-47209 and Japanese Laid-open Patent Specifications Sho 47-31828 and 47-31827 referred to hereinbefore, silicon is added intentionally for the purpose of deoxidation, and their claims and examples define more than 0.02% of silicon and show or suggest nothing of the feature of the present invention, namely the development of the (111) texture for improved workabilities and elimination of the silica inclusions by maintaining the silicon content less than 0.02%. It has been clarified why it is important to reduce the silicon content less than 0.02%. The production method for lowering the silicon content to less than 0.02% will be described hereinafter. The following method for lowering the silicon content is merely one example of the various methods which can be used.

For lowering the silicon content in the steel, various means may be considered, such as, the use of a low-silicon ferromanganese, increasing the proportion of molten pig steel, or adding oxides to oxidize the silicon in the molten steel and float it as an oxide. However, these means are not always sufficient to assure a silicon content of less than 0.02%.

The production method according to the present invention is to consistently reduce the silicon content in the steel to less than 0.020% which could not be attained by the conventional methods. By the present invention, it is possible to consistently obtain steel sheets or strips having excellent deep-drawability, stretchability and bore-expansion properties on a commercial scale using continuous casting techniques.

The method of the present invention will be described referring to FIG. 5 which shows the relationship between the oxygen content (T [O]) and the silicon content at the time of blowing-off of the converter.

Figure 5:
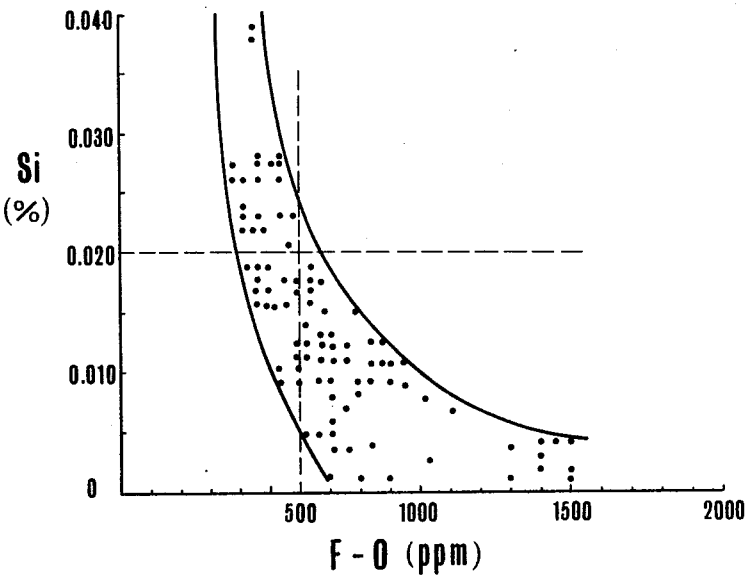
FIG. 5 is a graph showing the relation between the free oxygen (F-O in ppm) and Si (%) at the time of blowing-off of a converter.

As clearly understood from FIG. 5, as the blowing-off oxygen content (T [O]) increases, the silicon content in the steel decreases, and the silicon content decreases by oxidation due to the increase of the blowing-off oxygen content so that molten steel with an extremely reduced silica inclusion content can be obtained. In this case, in order to reduce the silicon content in the steel to less than 0.020%, it is necessary to maintain at least 600 ppm of the blowing-off oxygen (T [O]). Thus, contrary to the conventional methods in which silicon is intentionally added for the purpose of deoxidation, no silicon is added and silicon which is unavoidably contained during the steel making and oxygen blowing is intentionally reduced in the present invention.

When the blowing-off oxygen is more than 1600 ppm, a longer time is required for the blowing and a larger amount of deoxidation agents (Al and Ti) is required in the subsequent vacuum degassing step, a larger amount of deoxidation products is produced, and much time is required for floating and removing the oxidation products. Thus, the upper limit of the blowing-off oxygen content is set at 1600 ppm.

As noted, it is an important object of the present invention to improve the workability of both hot and cold rolled steel sheets by lowering the silicon content to less than 0.02%. For this purpose, it is essential that the steel be blown to an oxygen content from about 600 to 1600 ppm. This relatively high oxygen content is maintained for the specific object of lowering the silicon content.

The molten steel, with an extremely reduced silicon content in the converter, is tapped into a ladle where required amounts of low-carbon Fe-Mn, high-carbon Fe-Mn, and carbon are added, and the molten steel is then subjected to vacuum degassing for decarburization (and deoxidation). During the vacuum degassing treatment, when the carbon content becomes less than 0.020%, the free oxygen in the molten steel is measured, for example, by and oxygen determination cell, calculation from CO gas generation rate in the vacuum degassing tank, sand mold judgment, or a similar method. and Al is added for deoxidation to such a degree that blow holes, etc., do not occur during the continuous casting, i. e., until the free oxygen content is lowered to 150 ppm or less. Naturally, the addition of Al is not limited to the addition into the vacuum degassing tank.

The vacuum degassing of the molten steel should be continued until the carbon content in the molten steel is lowered to 0.020% or less, otherwise there is a danger of blow holes during the continuous casting. Al deoxidation should be done in such a manner that more than 0.005% of sol.Al is not contained in the steel. When the sol.Al content is over 0.005%, the steel structure tends to have a mixed grain structure, and when the steel is worked, striped patterns appear, thus damaging the outer appearance of the worked articles.

The deoxidation may also be done by using Al and Ti without an adverse effect. Thus, the limitation of not more than 0.005% of sol.Al and not more than 0.005% of Ti avoids problems, such as, mixed grains or surface defects. Regarding manganese, it is limited to 0.6% or less because a low manganese content is desirable for the workability. Also, other elements should be maintained at low levels because their lower contents assure better material quality.

The molten steel thus vacuum degassed is continuously cast according to a conventional method. For example, the molten steel is poured from the ladle into a tondish and then poured from the immersion nozzle into a mold. Regarding the drawing speed in the continuous casting, a relatively faster speed is desirable from the viewpoint of preventing blow holes.

The thus obtained steel slabs having a very low silicon content, i. e., less than 0.020%, and free from silica inclusions, are worked into final products by hot rolling, or worked into final products by cold rolling into a final thickness and softening annealing, or if necessary, decarburization annealing, decarburization-denitrization annealing. Cold rolled steel sheets can be used as strip steel, tinned steel sheet, zinc-coated plate, etc.

The present invention will be more clearly understood from the following example.

EXAMPLE

A mixture of 85% of molten pig iron and 15% of scrap was refined in a 100 ton converter with pure oxygen at a blowing rate of 1800 $Nm^2/hr$, and two charges having a blowing-off carbon content between 0.055 and 0.080% and a blowing-off oxygen content between 450 and 580 ppm, and three charges having a blowing-off carbon content between 0.025 and 0.063% and a blowing-off oxygen content between 750 and 1300 ppm were tapped. The conditions of refining and the properties of the steel sheets are shown in Table 4.

At the time of tapping, the above molten charges, 1 to 5 kg/t of high-carbon Fe-Mn or low-carbon Fe-Mn and a small amount of carbon were added to the ladle. As for the carbon, it must be lowered to 0.020% or less in the time period permitted during the degassing treatment through the reaction of $C + 0 = CO$, and this condition is satisfied if the carbon content before the vacuum degassing treatment is 0.10% or less.

After the carbon content in the molten steel was lowered to less than 0.02% by the vacuum degassing treatment, the total oxygen content was measured by a neutron radiation analysis method, and Al was added in an amount sufficient, but not excessive, to remove the oxygen. In the case of test S which had a blowing-off oxygen content of 1300 ppm, the molten steel was deoxidized with Al and Ti after the vacuum degassing treatment so as to assure not more than 0.005% of sol.Al and not more than 0.005% of Ti. The free oxygen content after these treatements was not more than 100 ppm.

The molten steel thus obtained was cast by a continuous slab casting machine.

The silicon contents in the samples U and T thus obtained from the molten steel having a blowing-off total oxygen content of 450 ppm and 580 ppm, respectively, are 0.021% and 0.025%, respectively.

On the other hand, the silicon contents in the samples R, S and V from the molten steel containing more than 600 ppm of blowing-off oxygen are 0.009%, 0.013% and 0.018%, respectively. In this way, steels containing less than 0.020% of silicon were obtained.

These slabs, R. S. T. U., and V were hot rolled with a finishing temperature between 855° and 865° C into hot coils of 2.5 mm thickness. Further, these hot coils were cold rolled into an 0.8 mm thickness, annealed at 670° C for 3 hours, and their properties were examined.

The results of testing the properties of these hot coils and cold rolled steel sheets are shown in Table 4. Regarding the bore-expansion properties of the hot coils, the present inventive steels R, S and V are better than the steels T and U and show more than 1.90. Also regarding the cold rolled materials, the present inventive steels R, S, and V show better deep-drawability, stretchability and bore-expansion properties than those of the steels T and U as is clearly understood from the comparison of their respective values.

Table 1

Composition (%) and Mechanical Properties of Cold Rolled Materials of 0.8 mm Thickness (annealed at 670° C for 3 hrs.) Manufactured from a Continuously Cast Slab

| Samples | Steels | C | Si | Mn | P | S | sol. Al | T . O | Ti |
|---|---|---|---|---|---|---|---|---|---|
| A | Inventive Steel | 0.011 | 0.001 | 0.41 | 0.010 | 0.014 | 0.002 | 0.0220 | |
| B | " | 0.015 | 0.005 | 0.32 | 0.015 | 0.011 | 0.002 | 0.0150 | |
| C | " | 0.008 | 0.012 | 0.25 | 0.012 | 0.011 | 0.001 | 0.0070 | |
| D | " | 0.004 | 0.014 | 0.30 | 0.007 | 0.008 | 0.001 | 0.0090 | 0.002 |
| E | " | 0.0016 | 0.018 | 0.29 | 0.007 | 0.009 | 0.003 | 0.0080 | |
| F | Si-remaining Steel | 0.010 | 0.023 | 0.30 | 0.009 | 0.012 | 0.001 | 0.0120 | |
| G | " | 0.015 | 0.027 | 0.28 | 0.013 | 0.013 | 0.002 | 0.0090 | |
| H | Rimmed Steel B: Comparative | 0.041 | 0.015 | 0.31 | 0.012 | 0.014 | 0.001 | 0.0270 | |

| Samples | Y.P. (kg/mm²) | T.S. (kg/mm²) | El (%) | G.S. No. | $\bar{r}$ | c.c.v. | Er | (111) Intensity | (200) Intensity |
|---|---|---|---|---|---|---|---|---|---|
| A | 19.5 | 30.5 | 49.0 | 8.9 | 1.46 | 37.5 | 10.95 | 6.1 | 0.80 |
| B | 18.0 | 30.1 | 50.1 | 8.4 | 1.51 | 37.1 | 10.75 | 6.0 | 0.65 |
| C | 18.8 | 30.4 | 48.2 | 7.8 | 1.38 | 37.4 | 10.70 | 5.8 | 0.75 |
| D | 18.0 | 30.8 | 46.8 | 8.6 | 1.26 | 37.2 | 10.85 | 5.4 | 0.90 |
| E | 18.1 | 30.0 | 46.2 | 8.5 | 1.26 | 37.5 | 10.75 | 5.2 | 0.80 |
| F | 22.2 | 32.0 | 42.2 | 8.1 | 1.01 | 38.3 | 10.25 | 3.7 | 1.10 |
| G | 23.8 | 32.3 | 42.0 | 8.8 | 0.90 | 38.0 | 10.22 | 3.5 | 1.00 |
| H | 19.4 | 32.8 | 45.6 | 8.4 | 1.20 | 38.22 | 11.22 | 4.4 | 0.81 |

Table 2

Compositions of 2.5 mm thick Hot Coils For Bore-Expansion Test (%)

| Samples | Steel Grades | C | Si | Mn | P | S | sol . Al | T . O | Cleanness: Silica(A) Inclusions $d_{60 \times 400(\%)}$ |
|---|---|---|---|---|---|---|---|---|---|
| I | Si-Al deoxidized Steel | 0.043 | 0.058 | 0.44 | 0.010 | 0.014 | 0.007 | 0.0210 | 0.12 |
| J | Si-remaining Steel | 0.011 | 0.025 | 0.32 | 0.007 | 0.011 | 0.001 | 0.0068 | 0.05 |
| K | Inventive Steel | 0.014 | 0.005 | 0.26 | 0.012 | 0.011 | 0.002 | 0.0079 | 0.01 |
| L | Inventive Steel | 0.008 | 0.016 | 0.30 | 0.011 | 0.015 | 0.002 | 0.0081 | 0.01 |
| M | Rimmed Steel B: Comparative | 0.033 | 0.015 | 0.31 | 0.012 | 0.014 | | 0.0270 | — |

Table 3

Compositions and Bore-Expansion Rate of Bore-Expansion Test Pieces of Tinned Steel Sheet (T-2, 0.32 mm)

| Samples | Steel Grades | C | Si | Mn | P | S | sol . Al | T . O | Bore-Expansion Rate (D/D.) |
|---|---|---|---|---|---|---|---|---|---|
| N | Si-Al deoxidized Steel | 0.054 | 0.061 | 0.49 | 0.014 | 0.013 | 0.003 | 0.0150 | 1.43 |
| O | Si-remaining Steel | 0.009 | 0.039 | 0.33 | 0.020 | 0.013 | 0.003 | 0.0120 | 1.56 |
| P | Inventive Steel | 0.007 | 0.005 | 0.30 | 0.008 | 0.013 | 0.003 | 0.0140 | 1.74 |
| Q | Rimmed Steel B: Comparative | 0.065 | 0.010 | 0.31 | 0.012 | 0.012 | | 0.0320 | 1.70 |

Table 4

Examples of Blowings For Lowering Silicon and Properties of Hot Coil and Cold Rolled Material

| Samples | Blowing-off Composition in Converter | | | | | Additive at Tapping | |
|---|---|---|---|---|---|---|---|
| | C (%) | Si (%) | Mn (%) | F . O (ppm) | Temperature (° C) | High C—Fe—Mn (kg/t) | Low C—Fe—Mn (kg/t) |
| R: Inventive Steel | 0.063 | 0.007 | 0.22 | 750 | 1670 | — | 2.00 |
| S: Inventive | 0.025 | 0.003 | 0.09 | 1300 | 1690 | 3.00 | — |

Table 4-continued

| | | | Examples of Blowings For Lowering Silicon and Properties of Hot Coil and Cold Rolled Material | | | | |
|---|---|---|---|---|---|---|---|
| Steel T: Si-remaining Steel | 0.055 | 0.021 | 0.23 | 580 | 1660 | — | 2.00 |
| Steel U: Si-remaining Steel | 0.080 | 0.022 | 0.20 | 450 | 1650 | 1.00 | — |
| V: Inventive Steel | 0.038 | 0.008 | 0.15 | 1020 | 1695 | 5.00 | 1.00 |

| | Additives at Tapping | | Composition of Molten Steel After Tapping | | | | |
|---|---|---|---|---|---|---|---|
| Samples | C (kg/t) | Al (kg/t) | C (%) | Si (%) | Mn (%) | T-O (ppm) | Temperature (° C) |
| R | — | 0.3 | 0.075 | 0.012 | 0.27 | 480 | 1610 |
| S | 0.2 | 0.3 | 0.061 | 0.013 | 0.28 | 740 | 1625 |
| T | — | 0.2 | 0.060 | 0.025 | 0.32 | 440 | 1610 |
| U | — | 0.1 | 0.085 | 0.021 | 0.29 | 380 | 1610 |
| V | — | 0.3 | 0.080 | 0.018 | 0.48 | 210 | 1610 |

| | Composition after Vacuum Degassing | | | | | | | | | |
|---|---|---|---|---|---|---|---|---|---|---|
| | | | | | | | | Amount of Alloying Elements | | |
| Samples | C (%) | Si (%) | Mn (%) | F-O (ppm) | sol. Al (%) | Ti (%) | Temp. (° C) | Mn (kg/t) | Al (kg/t) | Ti (kg/t) |
| R | 0.014 | 0.009 | 0.26 | 79 | 0.002 | — | 1570 | 0.5 | 0.3 | — |
| S | 0.009 | 0.013 | 0.30 | 55 | 0.004 | 0.003 | 1580 | 0.6 | 0.3 | 0.4 |
| T | 0.011 | 0.025 | 0.32 | 68 | 0.001 | — | 1575 | 0.2 | 0.3 | — |
| U | 0.018 | 0.021 | 0.29 | 58 | 0.003 | — | 1570 | 0.1 | 0.3 | — |
| V | 0.016 | 0.018 | 0.48 | 35 | 0.005 | — | 1570 | — | 0.2 | — |

| | Bore-Expansion Rate (D/D₀) of Hot Coil (2.5 mm) | Properties of Cold Rolled Steel Sheet (0.8mm annealed: 670° C × 3 hrs.) | | | | | | | | | |
|---|---|---|---|---|---|---|---|---|---|---|---|
| Samples | | Y. P (kg/mm²) | T. S (kg/mm²) | El (%) | G. S No. | $\bar{r}$ | c.c.v | Er | (222) Intensity | (200) Intensity | Bore-Expansion Rate (D/D₀) |
| R | 2.05 | 18.2 | 30.1 | 49.2 | 8.8 | 1.48 | 37.2 | 10.8 | 5.8 | 0.62 | 2.12 |
| S | 1.95 | 19.0 | 32.8 | 48.2 | 8.4 | 1.38 | 37.5 | 10.9 | 6.0 | 0.70 | 2.08 |
| T | 1.54 | 22.6 | 34.6 | 42.5 | 9.1 | 1.22 | 38.8 | 10.2 | 4.2 | 1.15 | 1.95 |
| U | 1.65 | 21.9 | 32.2 | 43.6 | 8.4 | 1.24 | 38.0 | 10.5 | 4.9 | 1.20 | 1.93 |
| V | 1.90 | 19.0 | 30.2 | 46.1 | 8.5 | 1.30 | 37.4 | 10.8 | 5.0 | 1.04 | 2.05 |

What is claimed is:

1. A method for producing a continuously cast steel slab for use in manufacturing steel sheets having excellent workabilities which comprises blowing molten steel to a total oxygen content between 600 ppm and 1600 ppm and a silicon content less than 0.02% with a carbon content not more than 0.10%, tapping the molten steel into a ladle, vacuum degassing the molten steel to effect decarburization and deoxidation together with deoxidation adjustment with a material selected from the group consisting of Al and a mixture of Al and Ti to obtain a molten steel containing not more than 0.02% of carbon, less than 0.02% of Si, not more than 0.6% of manganese, not more than 0.005% of sol. aluminum, not more than 0.005% of titanium, not more than 150 ppm of free oxygen with a reduced content of silica inclusions, continuously casting the molten steel and then cold reducing the cast steel at a reduction of not less than 60% to obtain a silicon inclusion clearness of $d_{60} \times 400 \leqq 0.01\%$.

2. A continuously cast steel slab produced by the method of claim 1.

* * * * *

UNITED STATES PATENT OFFICE

CERTIFICATE OF CORRECTION

Patent No. 4,073,643 Dated February 14, 1978

Inventor(s) Ko Kumai et al

It is certified that error appears in the above-identified patent and that said Letters Patent are hereby corrected as shown below:

In the heading of the patent [30] should read as follows:

--[30] Foreign Application Priority Data

May 29,1973 Japan.....Sho 48-60073--.

Signed and Sealed this

Ninth Day of May 1978

[SEAL]

Attest:

RUTH C. MASON
Attesting Officer

LUTRELLE F. PARKER
Acting Commissioner of Patents and Trademarks